US009324308B1

(12) United States Patent
Clarke

(10) Patent No.: US 9,324,308 B1
(45) Date of Patent: Apr. 26, 2016

(54) GUITAR STRING BENDER

(71) Applicant: Timothy Clarke, Georgetown (CA)

(72) Inventor: Timothy Clarke, Georgetown (CA)

( * ) Notice: Subject to any disclaimer, the term of this patent is extended or adjusted under 35 U.S.C. 154(b) by 0 days.

(21) Appl. No.: 14/644,812

(22) Filed: Mar. 11, 2015

(51) Int. Cl.
*G10D 3/14* (2006.01)

(52) U.S. Cl.
CPC ..... *G10D 3/143* (2013.01)

(58) Field of Classification Search
CPC ..... G10D 3/143
See application file for complete search history.

(56) References Cited

U.S. PATENT DOCUMENTS

| | | | | | |
|---|---|---|---|---|---|
| 2,949,806 | A | | 8/1960 | Turman | |
| 3,479,914 | A | | 11/1969 | Zitnik, Jr. et al. | |
| 3,479,917 | A | * | 11/1969 | Zitnik, Jr. | G10D 3/143 84/312 R |
| 3,686,993 | A | * | 8/1972 | Fender | G10D 3/143 257/720 |
| 4,535,670 | A | | 8/1985 | Borisoff | |
| 5,140,884 | A | | 8/1992 | Bowden | |
| 5,323,680 | A | * | 6/1994 | Miller | G10D 3/14 84/455 |
| 5,413,019 | A | | 5/1995 | Balnda, Jr. | |
| 5,542,330 | A | * | 8/1996 | Borisoff | G10D 3/143 84/298 |
| 7,329,808 | B2 | * | 2/2008 | Davis | G10D 3/143 84/298 |
| 7,696,420 | B2 | | 4/2010 | Thompson | |
| 2011/0067549 | A1 | * | 3/2011 | Kingsley | G10D 1/02 84/312 R |
| 2013/0180378 | A1 | * | 7/2013 | Baker | G10D 3/146 84/313 |
| 2014/0196590 | A1 | * | 7/2014 | Glaser, II | G10D 3/143 84/453 |
| 2014/0224096 | A1 | * | 8/2014 | Callison | G10D 3/143 84/312 R |
| 2015/0007705 | A1 | * | 1/2015 | Lionello | G10D 3/143 84/298 |

* cited by examiner

*Primary Examiner* — Robert W Horn

(57) ABSTRACT

The invention pertains to a string bender device for use with a stringed instrument, particularly with a guitar. The bending device comprises a mount, an activation lever and a spring device coupled therebetween. The string bender further includes an anchoring arrangement to secure the anchor portion of a guitar string to the string bender. When in use the guitar string anchor is attached to the bending device while the free end of the guitar string is wound around a tuning peg of the guitar. The tension of the string is adjusted using the tuning peg until a desired neutral tone of the string is achieved. The position of the spring at this tension is defined as the neutral position of the string. The activation lever can then be moved in a first direction to deform the spring in a first direction and move the anchor of the guitar string away from the tuning pegs, causing an increase in string tension and thus raising the tone of the affected string. Alternatively the activation lever can be moved in a second direction to deform the spring in a second direction and move the guitar string anchor towards the tuning pegs, causing a decrease in tension of the affected string and thus a decrease in tone. The present invention is advantageous in that it can raise or lower the tone of the affected string. Furthermore the string bender of the present invention uses existing structures on traditional guitars to facilitate mounting of the string bender thereto.

13 Claims, 13 Drawing Sheets

GUITAR STRING BENDER

FIELD OF THE INVENTION

The invention pertains to string bending devices for use on stringed instruments. In particular, the string bending device is particularly adapted for use with guitars.

BACKGROUND OF THE INVENTION

Many devices exist in the music industry which allows musicians of stringed instruments, particularly guitars, to mechanically alter the pitch of a string. Such a device allows the artist great flexibility in providing a vibrato effect on a single string of the instrument. It is often used in country music to provide a country twang.

There are some known string benders which currently exist in the marketplace and each design varies greatly in terms of how it is mounted on the guitar and how it is activated during the playing of a guitar. Many of these devices require permanent structural changes to the guitar such as screwing in the device to the guitar body or hollowing out a portion of the rear of the guitar to accommodate the bending device. Additionally, the devices often contain mechanical stop mechanisms to ensure that the guitar string stays in tune when in neutral position.

The mechanical stops are also used to limit the amount by which the tone of the string being bent can be changed, typically to one or two semitones. Such mechanical stops limit the movement of the string to a single direction, either up or down in pitch. This limits the creative options for the artist. Additionally, the devices are unable to effect the string pitch more than one or two semi-tones.

The string bending devices of the prior art tend to be relatively complex, requiring many parts and a great deal of space on the guitar body. As such, there are none that enable more than one guitar string to have a bending device mounted thereon. Again, this limits the creative options for the artist as only select strings can be bent.

There exists a need for a guitar string bender which can allow for the bending of the string both up or down in pitch, small in size and simple in design, thus allowing for multi string benders to be mounted on a guitar at one time.

There is also a need for a pitch-bender to have a greater range than one or two semi-tones.

SUMMARY OF THE INVENTION

In a first aspect of the invention, the string bender for use with a stringed instrument comprises a mount to couple the string bender to the stringed instrument, a spring device coupled between the mount and an activation lever and an anchoring arrangement to secure an anchor portion of an instrument string having a string portion and an anchor portion. The anchoring arrangement cooperates with the spring device such that when the instrument string is tensioned to achieve a desired neutral tone, the spring device is in a neutral position. The spring device is deformable such that by moving the activation lever in a first direction, the spring device is deformed from the neutral position in a first direction and the anchor portion of the string is moved to create increased tension of the instrument string, which raises the tone produced by said instrument string.

In another aspect of the invention, the spring device is deformed in a second direction by moving the activation lever of the string bender in a second direction. This causes the anchor portion of the instrument string to move in such a way that the tension on the instrument string is decreased, lowering the tone produced by the instrument string.

In yet another aspect of the invention, the stringed instrument is a guitar and the instrument string is a guitar string.

In a further aspect of the invention, the anchoring arrangement is a string aperture sized to allow the string portion of the guitar string to pass through while preventing the passage of the anchor portion to secure the guitar string to the string bender.

In yet a further aspect of the invention, the mount is adapted to be coupled to a guitar having a tailpiece and the mount comprises a mounting bolt sized such that the body of the mounting bolt passes through a string channel in the tailpiece of a guitar while the head of the mounting both abuts a surface about the channel.

In yet a further aspect of the invention, the spring device is U-shaped having a first leg and a second leg and the body of the mounting bolt passes through the channel and engages the first leg of said U-shaped spring device.

In yet a further aspect of the invention, the second leg of the spring device is coupled to the activation lever and the string aperture is provided in the second leg of the spring device.

In another aspect of the invention, the mount is adapted to be coupled to a guitar having a bridge plate assembly and a channel extending through the guitar body. A mounting bolt is used to couple the mount to the guitar body. The mounting bolt comprises a body and a head and the body of the mounting bolt is sized to pass through said channel and the head is sized to abut a surface about said channel. Once passed through the channel, the mounting bolt body engages the mount, coupling the mount to the guitar.

In yet another aspect of the invention, the spring device is U-shaped and has a first leg and a second leg. The first leg is coupled horizontally to the mount and the second leg is coupled to the activation lever.

In a further aspect of the invention, the mount includes an overhead bridge and anchoring arrangement is positioned above and rearwardly of the overhead bridge.

In yet a further aspect of the invention, a lever mount is coupled between the second leg of the spring device and the lever. The lever mount includes the string aperture for securing the guitar string.

In yet a further aspect of the invention, the activation lever includes a forwardly extending handle and a rearwardly extending handle.

In another aspect of the invention, the string bender for use with a stringed instrument comprises amount to couple the string bender to the stringed instrument, a spring device coupled between the mount and an activation lever and an anchoring arrangement to secure an anchor portion of an instrument string having a string portion and an anchor portion. The anchoring arrangement cooperates with the spring device such that when the instrument string is tensioned to achieve a desired neutral tone, the spring device is in a neutral position. The spring device is deformable such that by moving the activation lever in a first direction, the spring device is deformed from the neutral position in a first direction and the anchor portion of the string is moved to create decreased tension of the instrument string, which lowers the tone produced by said instrument string.

IN THE FIGURES

Preferred embodiments of the present invention are illustrated in the attached drawings in which.

DETAILED DESCRIPTION

Figure 1:
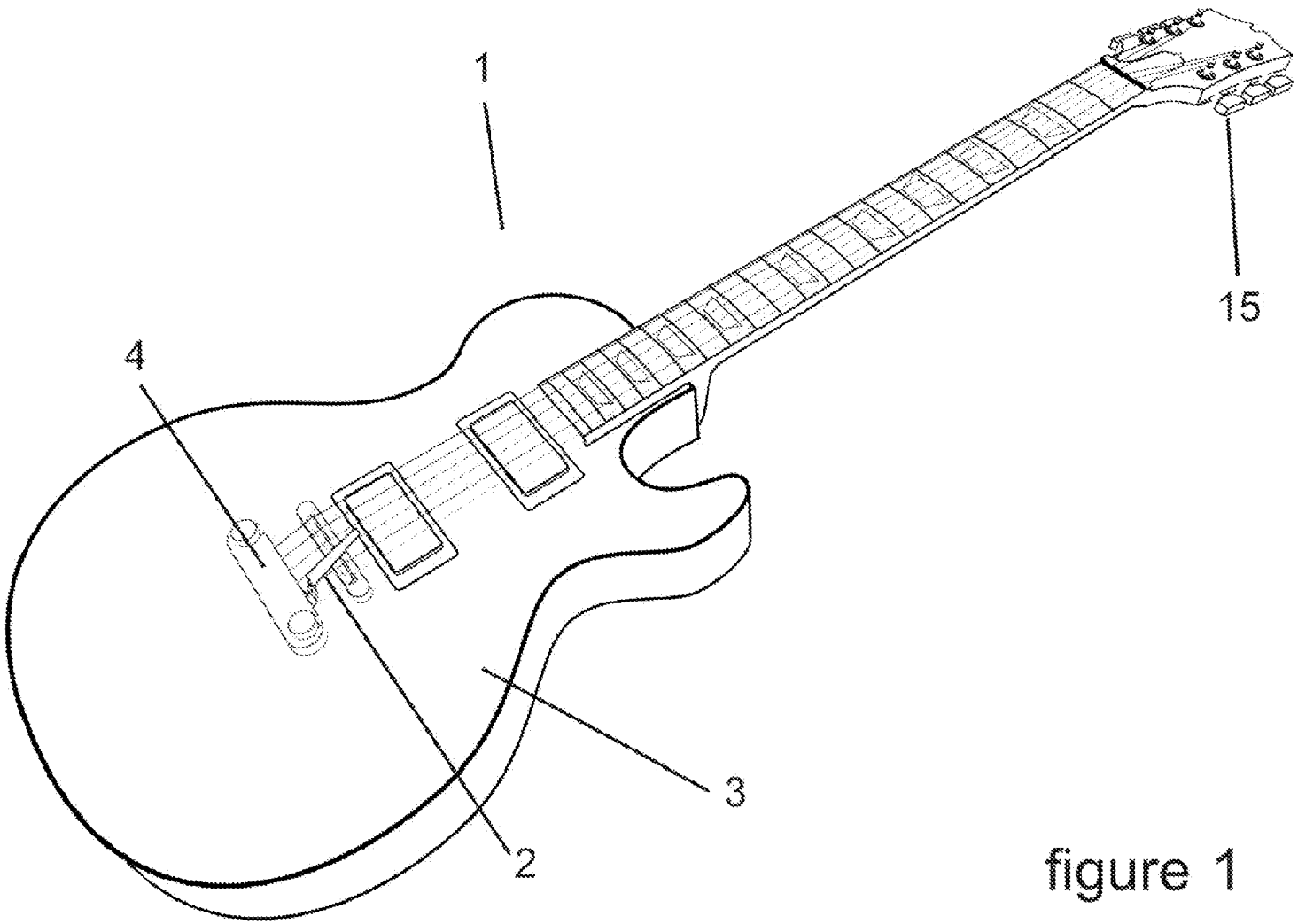
FIG. 1 shows one embodiment of the guitar string bender mounted on a guitar with a tail piece.
Figure 2:
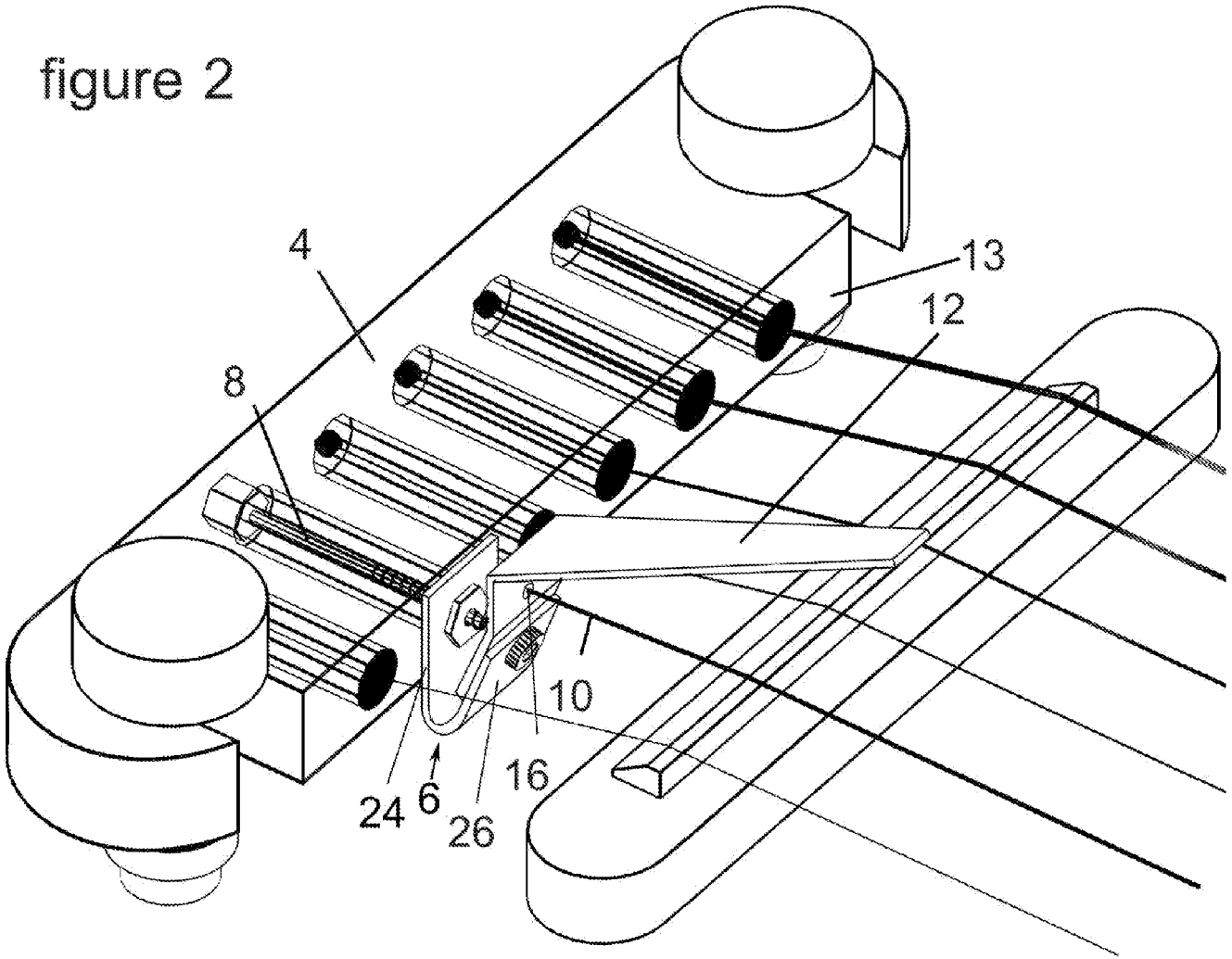
FIG. 2 shows a first embodiment of the guitar string bender mounted on a tail piece.

The invention pertains to a guitar string bender which allows the pitch of the string to be raised and lowered, is easy to mount, and can be used in combination with a vibrato arm. The string bender of the present invention does not require structural changes to the instrument, which is advantageous in that many guitars lose value of the instrument if they are altered. FIGS. 1 and 2 show the guitar string bending apparatus 2 mounted on a tail piece 4 of a guitar 1. In this particular embodiment the string bender 2 comprises a spring 6 mounted to the tail piece 4 using a tail piece attachment bolt 8. The affected string 10 is anchored to the spring 6 via a hole 16 in the handle 12 which is coupled to the spring 6.

Figure 3:
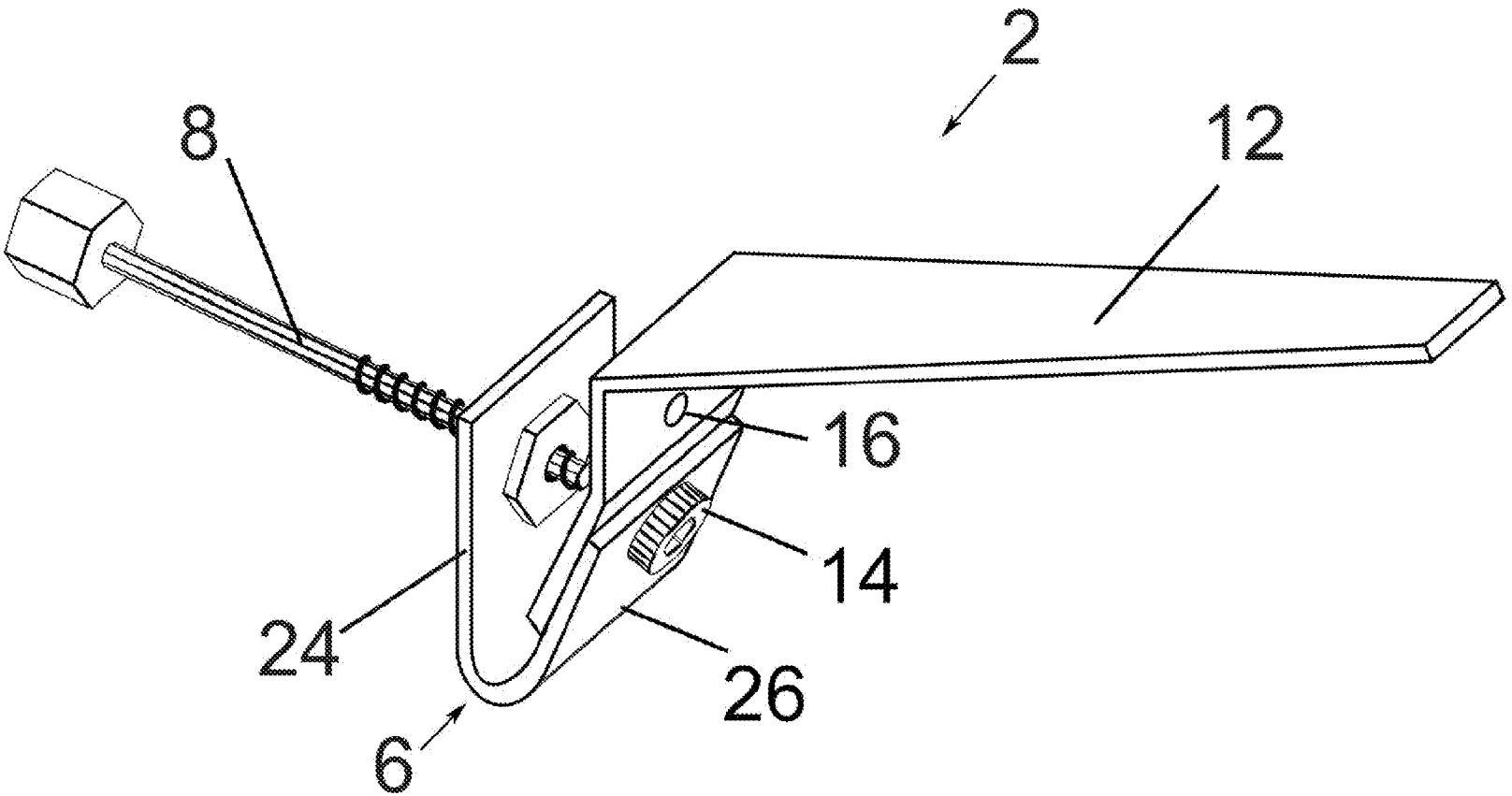
FIG. 3 shows a first embodiment of the guitar string bender when it is not mounted to a guitar.

As shown in FIG. 3, the guitar string bender is of a simple construction. The string bender comprises a mounting bolt 8 which can be fed through the tail piece of certain guitars, having a tail piece with channels therethrough for attaching strings. One such example is the Gibson Les Paul guitar.

A mounting bolt 8 is used to couple the spring 6 of the string bender 2 to the tail piece of a guitar. A U-shaped spring 6 could take different forms, however, in the preferred embodiment shown in the figures, the spring is generally U-shaped. The U-shaped spring has a first leg 24 having a hole to receive a mounting bolt 8. The first leg 24 is configured to lay flat, adjacent the inner wall 13 of the tail piece 4. This preferred embodiment helps to conserve the space occupied by the string bender 2, making the string bender less obtrusive to the player. The U-shaped spring 6 further compromises a second leg 26 integrally connected to the first leg 24. The second leg 26 is equipped to facilitate the coupling of a handle 12 and guitar string 10 thereto. The handle 12 is coupled to the spring 6 and is used to activate the string bender 2. In this particular example the handle 12 is mounted to the U-shaped spring 6 via a handle mounting screw 14, however it can be appreciated that any suitable coupling means could be used or the handle 12 could be formed continuously and/or monolithically with the U-shaped spring 6.

Figure 4:
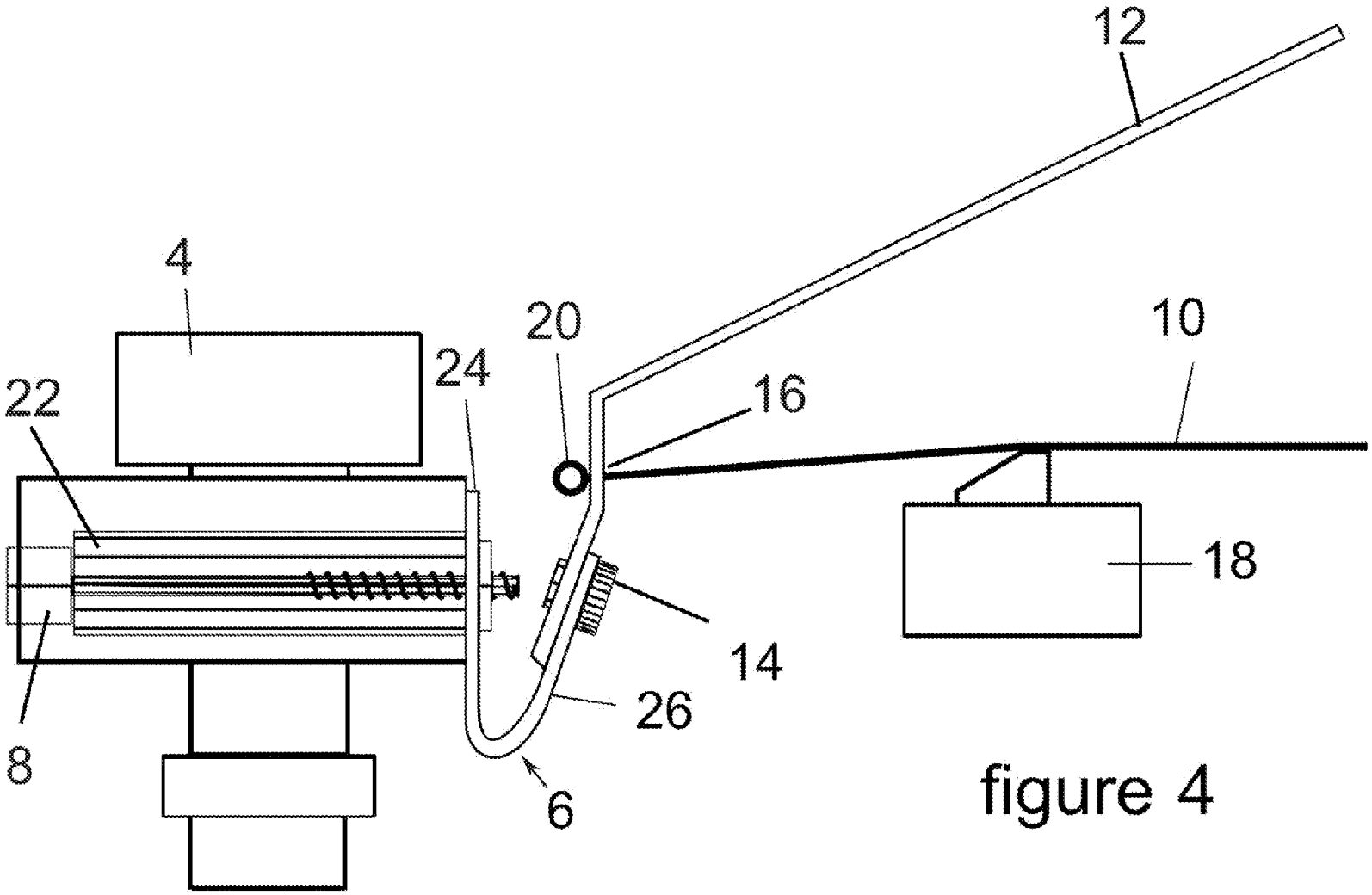
FIG. 4 shows a side view of the first embodiment of the guitar string bender mounted to a tail piece.

FIG. 4 shows an example of one embodiment of the string bender attached to the tail piece of a guitar. The tail piece 4 has a channel 22 which can accommodate the body of the mounting bolt 8 of the string bender. The mounting bolt 8 is sized such that the body of the mounting bolt 8 passes through the string channel 22 of the tail piece 4 while the head of the mounting bolt abuts the surface around the channel and cannot pass through. The body of the mounting bolt also passes through an aperture in the U-shaped spring 6. The U-shaped spring 6 abuts the surface of the tailpiece opposite the surface contacted by the head of the mounting bolt. A nut is used to secure the U-shaped spring 6 to the mounting bolt 8. This secures the U-shaped spring 6 to the tailpiece 4.

Traditional guitar strings have an anchor on one end thereof and no attachment on the other end. When a user is mounting a string 10 to a guitar equipped with a string bender 2, they would pass the attachment free end of the string 10 through a hole 16 in the handle until the anchor 20 was directly adjacent the handle. Alternatively the hole 16 could be in the second leg 26 of the U-shaped spring 6. The string 10 is then positioned over a bridge 18 and connected to a tuning peg 15 (shown in FIG. 1) at the opposite end of the guitar 1. The string pitch can then be adjusted to a tone acceptable to the player by turning the turning peg 15 which tightens or loosens the string.

The U-shaped spring 6 is made of a material which has sufficient stiffness to maintain its position and shape when a guitar string is under tension and properly tuned. One example of a suitable material is spring metals.

The string bender can be activated by either lifting the handle 12 away from the body of the guitar 1 or by depressing the handle 12 towards body 3 of the guitar 1. The lifting of the handle compresses the U-shaped spring 6. In the particular embodiment, shown in FIGS. 1 through 4 the spring is U-shaped and lifting the handle 12 causes the second leg 26 to be tilted toward the first leg 24. Since the guitar string 10 is connected via the handle to the spring, this upward and rearward movement of the handle 12 causes the guitar string tension to increase and thus raises the pitch of the string 10.

In contrast, when the handle 12 is depressed toward the body 3 of the guitar 1, the second leg 26 of the spring 6 is tilted away from the first leg 24 of the spring 6. Since the string 10 is anchored to the handle, which is connected to the spring, this depression causes the tension of the spring to decrease and thus lowers the pitch of the string 10.

Depending on the stiffness of the material used to make the spring, the range of variation in the pitch that is possible could be changed. By using spring metal as the material a range of 3 semitones and part 5 semitones down is achieved.

The concept of using a spring device to maintain a neutral position of a guitar string and having a handle attached thereto to change the pitch of the guitar string can be applied to various designs of guitars.

FIGS. 6 through 9 show an alternate embodiment in which a spring based string bender 114 is applied to a bridge plate apparatus 115 as opposed to a tail piece. An example of a guitar with this particular arrangement is the Fender Telecaster.

Figure 5:
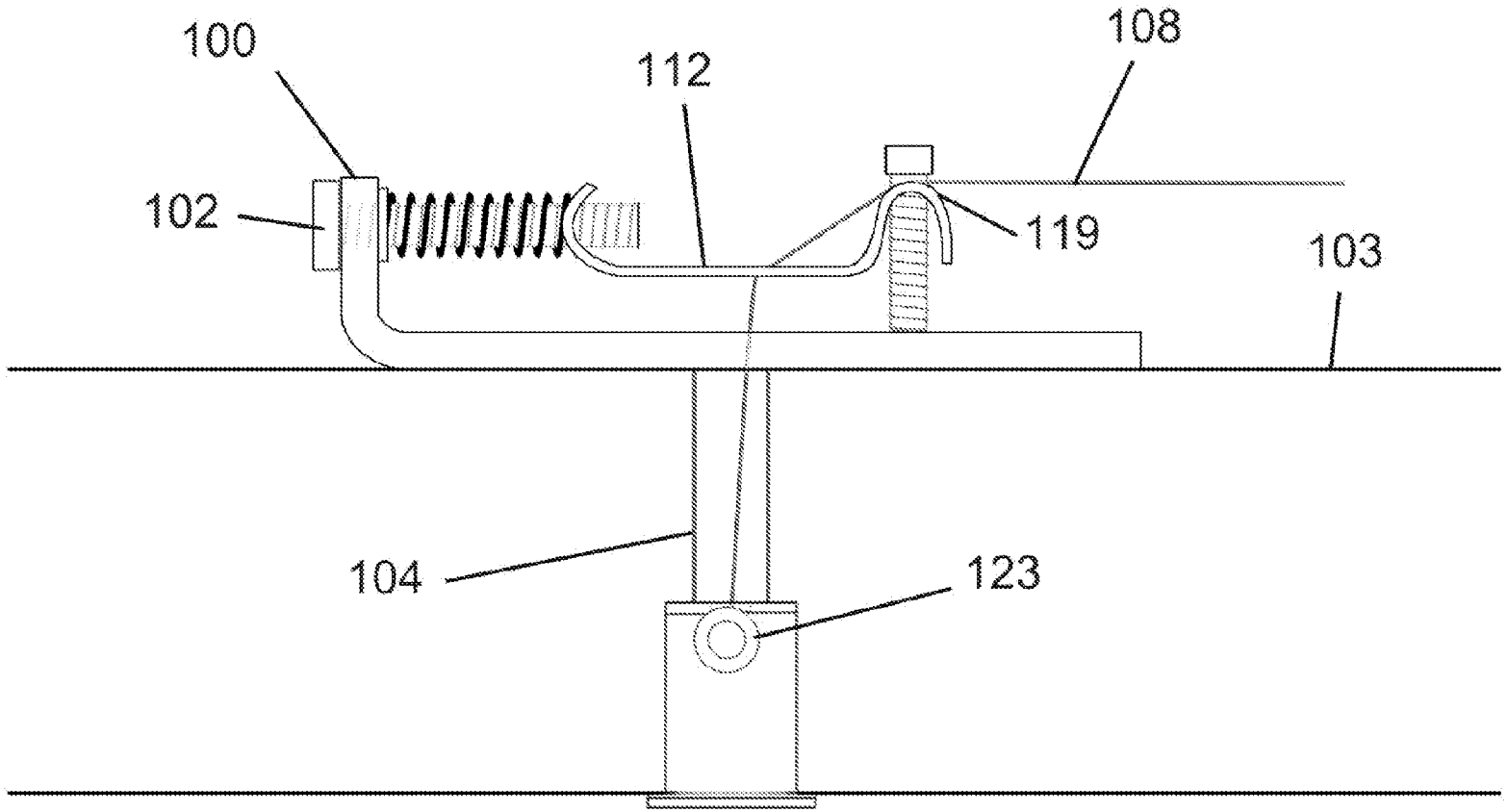
FIG. 5 shows the traditional set up of a bridge plate assembly.

FIG. 5 shows the traditional arrangement of a guitar having a bridge plate 100. The bridge plate 100 is mounted on the body 103 of the guitar and has a bridging device 112 disposed thereon. The bridging device 112 is coupled to the bridge plate 100 by an intonation adjustment bolt 102. The intonation adjustment bolt 102 can be adjusted to pull the bridging device 112 forward and back relative to the guitar body 103. When in use, a guitar string 108 is fed through from the back of the guitar through a hole 104 in the guitar body 103 and the anchor 123 of the guitar string 10 rests against the rim of the hole 104, through which it cannot pass. The string is then directed through an opening in the bridging device 112, over the ridge 119 of the bridging device 112, and is secured at the far end of the guitar using a tuning pin.

Figure 6:
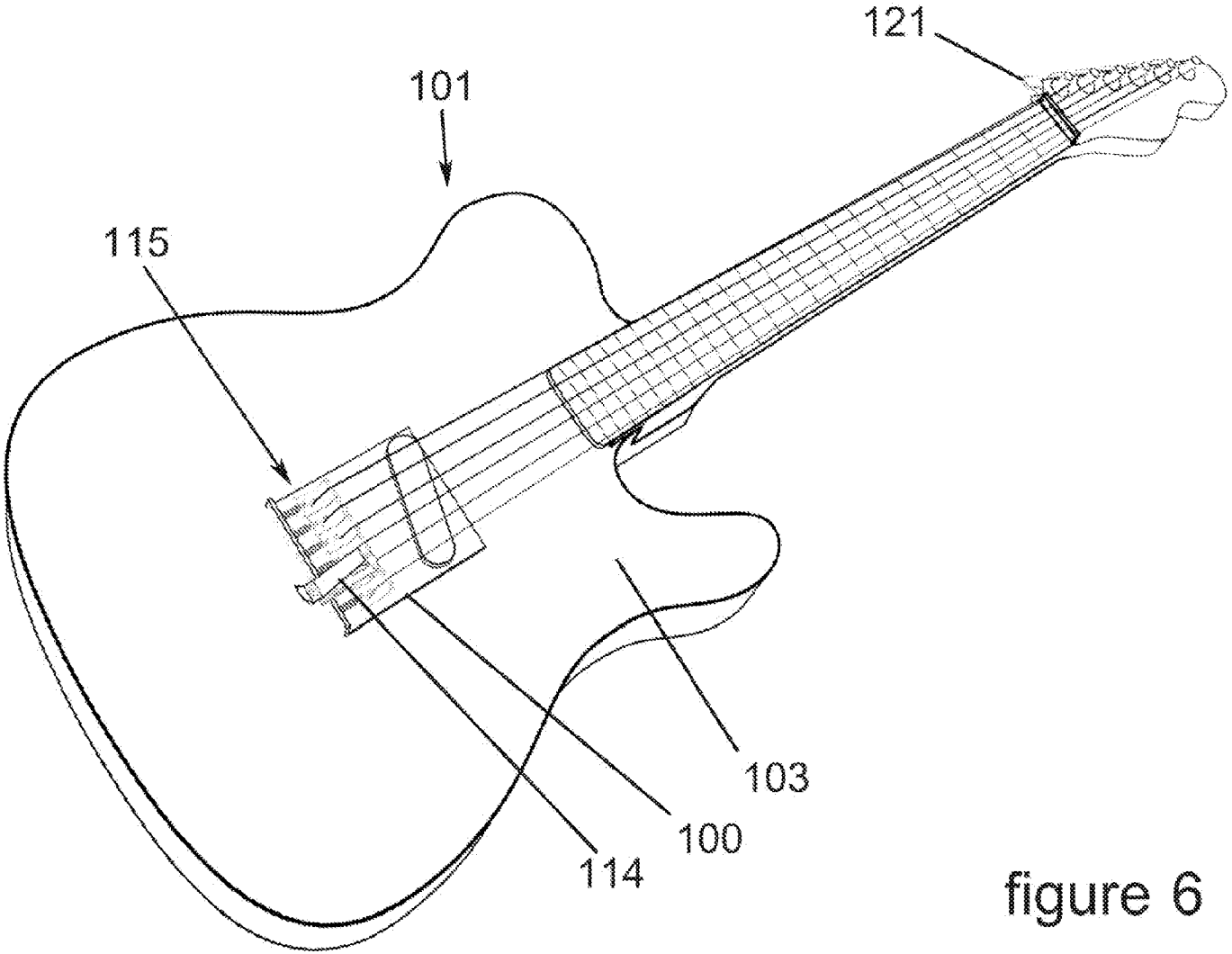
FIG. 6 shows a second embodiment of the guitar string bender mounted to a guitar having a bridge plate assembly.
Figure 7:
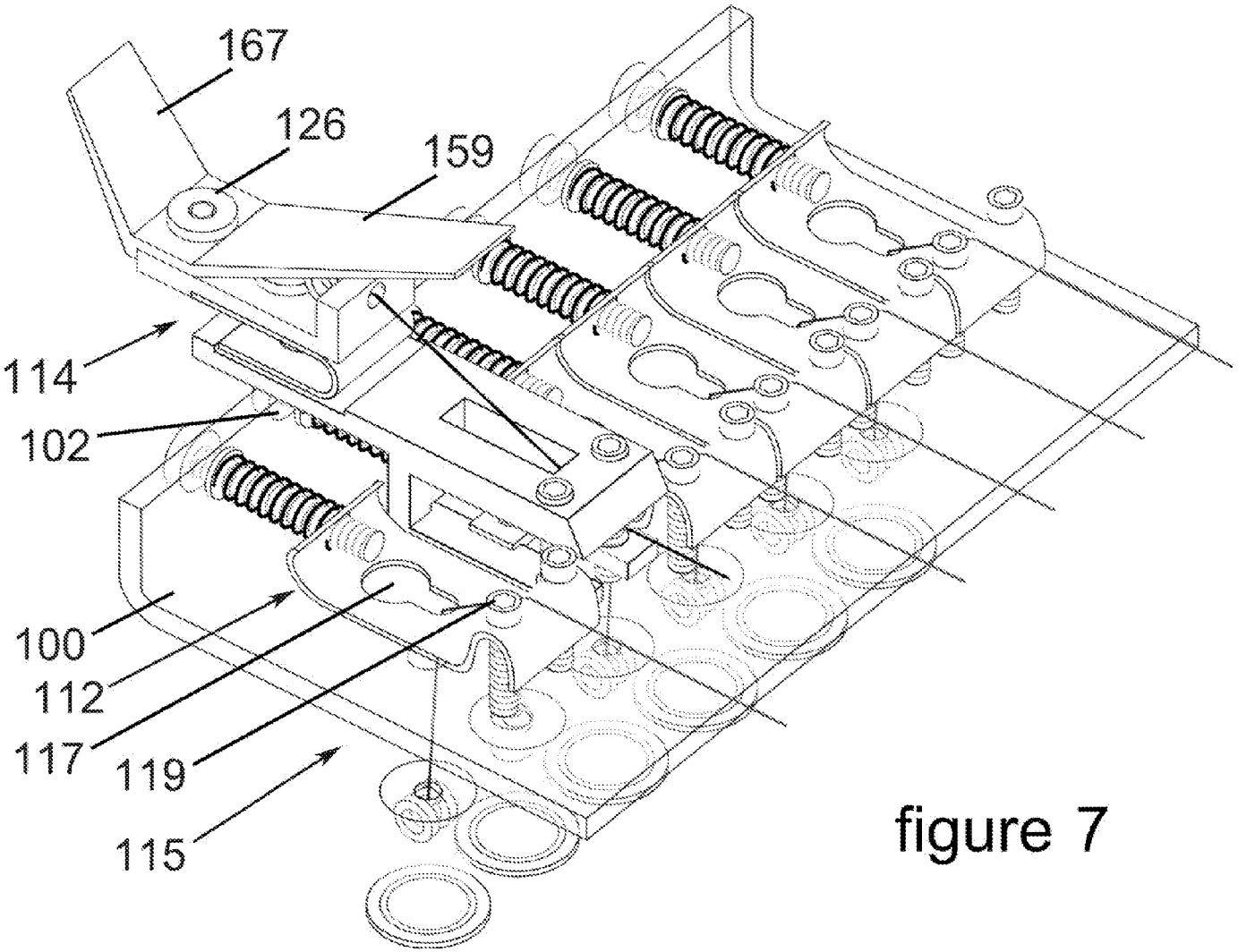
FIG. 7 shows a perspective view of the second embodiment of the guitar string bender mounted to a bridge plate assembly.
Figure 8:
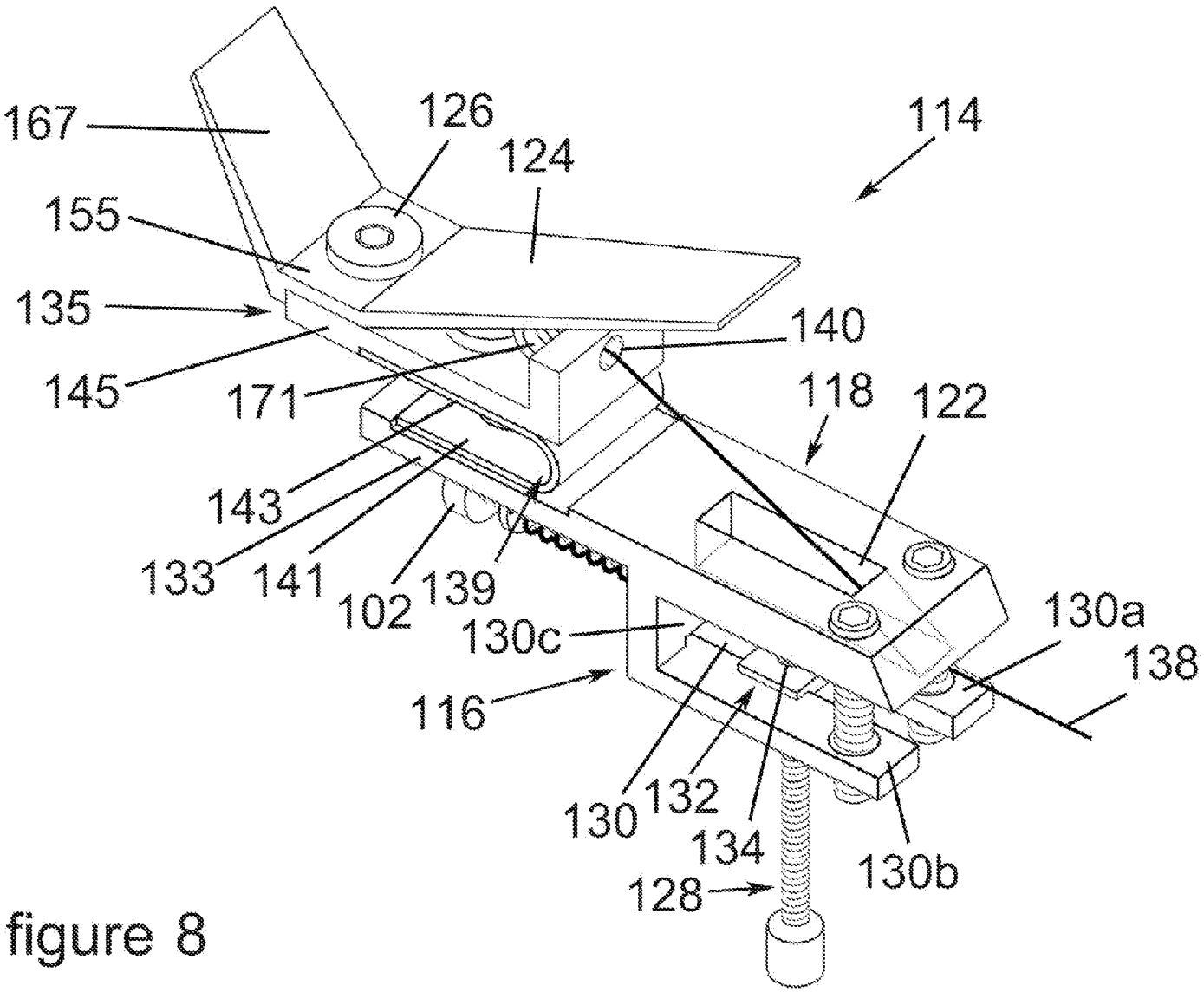
FIG. 8 shows a perspective view of the second embodiment of the guitar string bender in assembled form.
Figure 9:
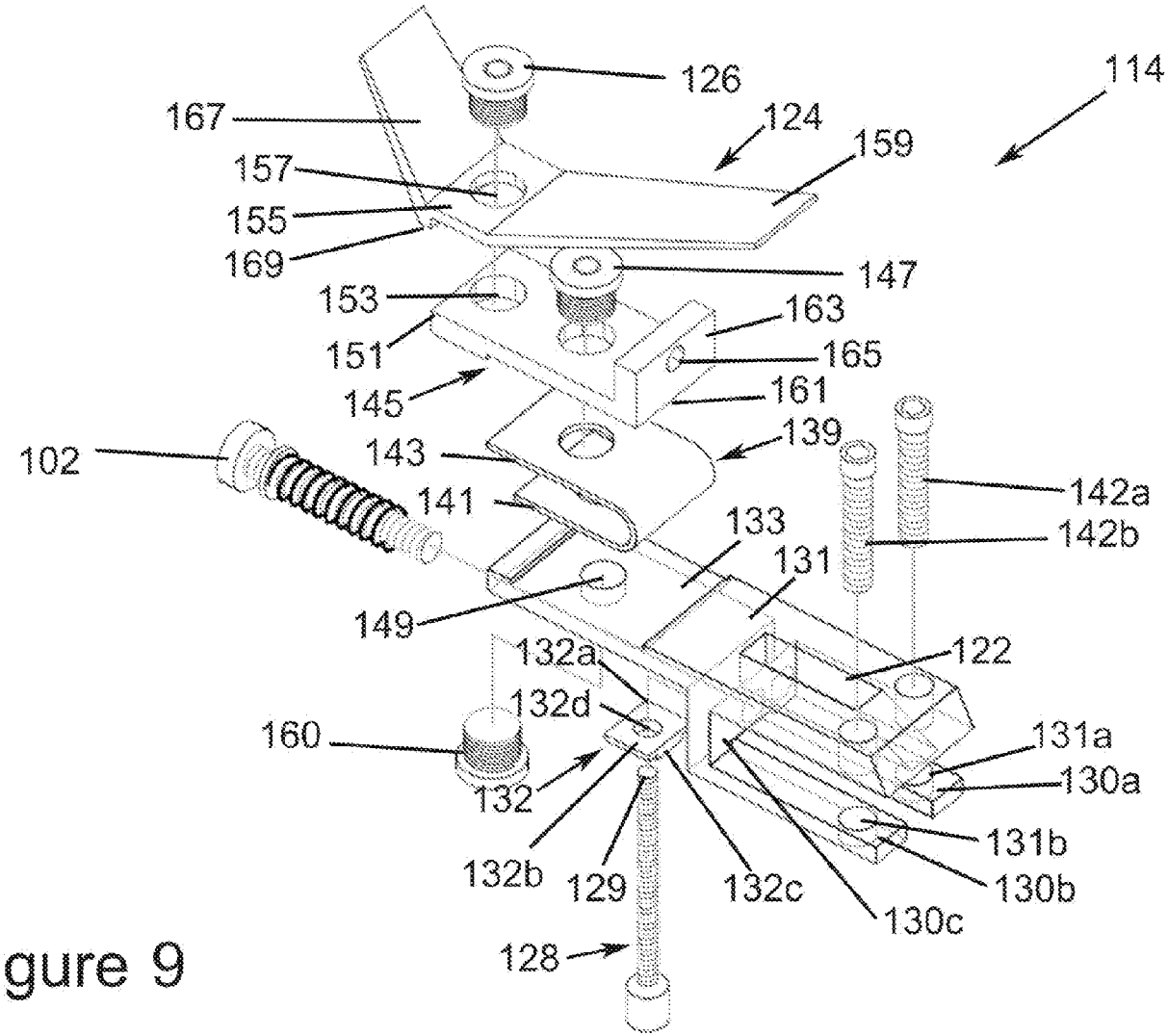
FIG. 9 shows a perspective exploded view of the second embodiment of the guitar string bender.
Figure 10:
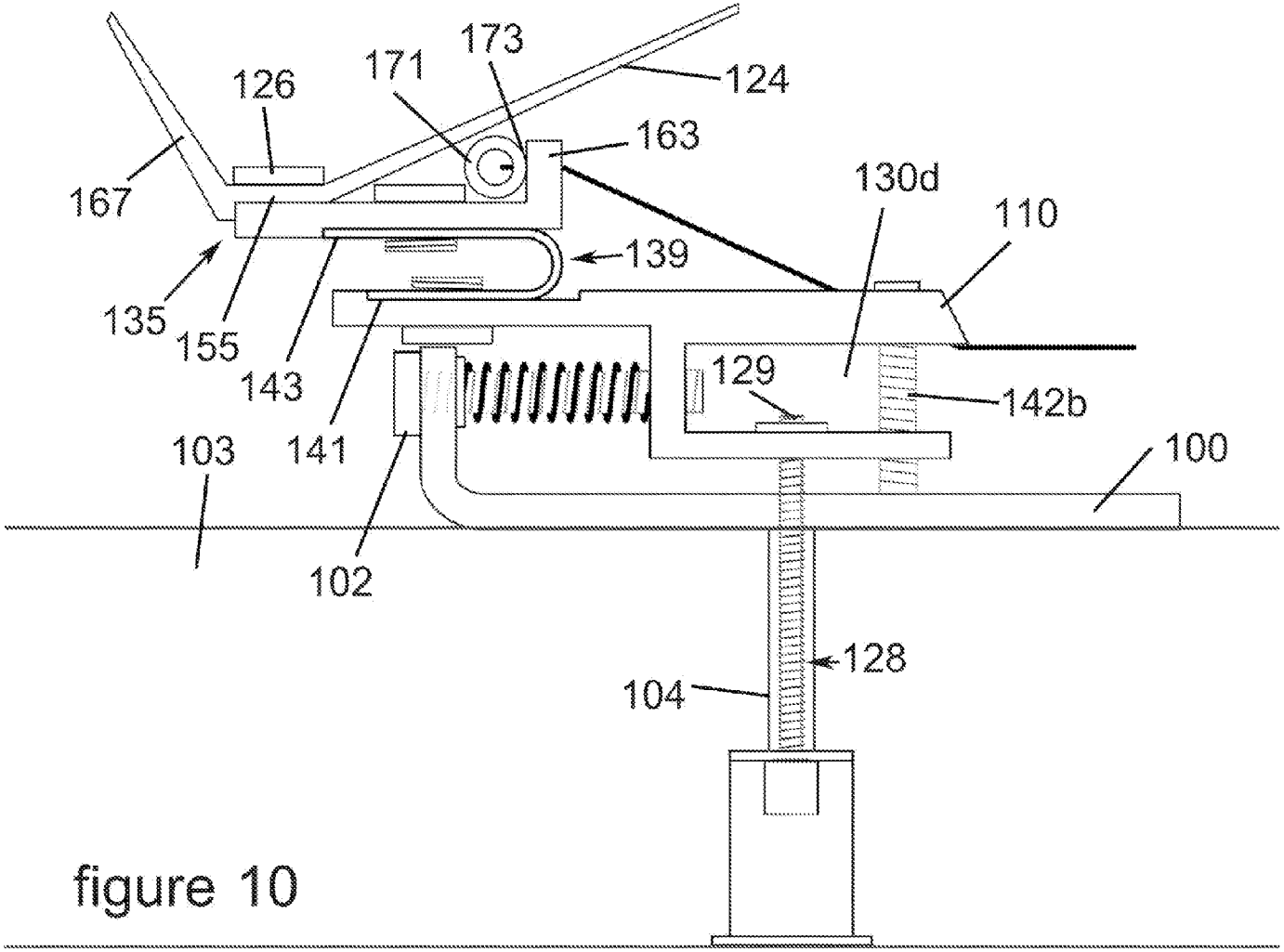
FIG. 10 shows a side elevation view of the guitar string bender mounted to a bridge plate assembly.

The string bender 114 for this particular style of guitar is shown mounted to a guitar in FIGS. 6, 7 and 10 and independently in FIGS. 8 and 9. The bending device 114 is mounted in place of a traditional bridging device. The string bender 114 comprises a mounting block 116 for mounting to the bridge plate 100. The mounting block 116 is fitted with a channel 130 formed by a first arm 130*a* and a second arm 130*b* coupled together by an upwardly extending connecting wall 130*c*.

To mount the string bender 114 to a guitar, a mounting screw 128 is fed from the back of the guitar body 103 through the bridge plate 100 and into the channel 130 (as shown in FIG. 10). The top portion 129 of the mounting screw 128 is coupled to a T-shaped nut 132. The T-shaped nut 132 (shown in FIG. 9) is shaped to have a first arm 132*a* and a second arm 132*b* which, when the string bender is in use, contact the top surfaces of arms 130*a* and 130*b* respectively. The middle portion 132*c* of the T-shaped nut have a greater thickness than the arms 132*a* and 132*b* and a width that generally corresponds to the width of the channel 130. The middle portion 132*c* of the T-shaped nut 132 is provided with a threaded hole 132*d* to receive and engage with the mounting screw 128. As the mounting screw 128 is tightened from the back of the guitar 101, the T-shaped nut 132 is pulled down the mounting screw 128 and compresses the first arm 130*a* and second arm 132*b* between arms 132*a* and 132*b* respectively and the bridge plate 100, thus securing the mounting block 116 to the bridge plate apparatus 115.

The upwardly extending wall 130*c* includes a threaded hole there through for coupling with the traditional intonation adjustment bolt 102. This allows for the string bender 114 to be moved forward and backward relative to the guitar body 103.

The upwardly extending wall 130*c* further includes a mounting body 131 coupled to the top of it which extends forward and back of the upwardly extending wall 103*c*. The mounting body 131 is generally parallel to the first arm 130*a* and second arm 130*b*. A front portion 137 of the mounting body 131 provides an overhead bridge 118. The overhead bridge 118 has a bridging component 120 and an aperture 122. A rear portion 133 of the mounting body 131 is provided to facilitate the coupling of a bending assembly 135.

A U-shaped spring 139, having a first leg 141 integrally connected to a second leg 143 is positioned horizontally on the rear portion 133 of the mounting body 131. Each of the rear portion 133 and the first leg 141 is provided with holes which are aligned axially with each other when the U-shaped spring 139 is properly positioned. An attachment bolt 160 is used to couple these two components on the rear portion 133 of the mounting body 131. A handle block 145 and the second leg 143 of the spring 139 are also equipped with holes which are axially aligned with each other. The handle block 145 is coupled to the second leg 143 of the U-shaped spring 139 using a screw 147 (shown in FIG. 8) which passes through and engages threads in handle block 145 and the second leg 143.

The handle block 145 has a rear edge 151 and a front edge 161. In close proximity to the rear edge 151 of the handle block 145, a hole 153 is provided to facilitate the attachment of the handle 124 to the handle block 145. The handle 124 comprises a base portion 155 that has a hole 157 that is axially aligned with the hole 153 of the handle block 145. For easy assembly the base portion 155 is also provided with a lip 169 on the bottom surface thereof. The lip abuts the rear edge 151 of the handle block 145 to ensure easy positioning and aligning of the holes 157 and 153. A screw 126 is passed through the hole 157 in the base portion 155 of the handle 124 and is engaged with threads on the inside of hole 153 in the handle block 145. This couples the handle 124 to the handle block 145. By providing this coupling between the handle 124 and the handle block 145 the handle 124 is essentially coupled to the spring 139 and the mounting body 131. Extending forwardly from the base portion of the handle 124 is a forward lever 159. Extending rearwardly from the base portion of the handle 124 is a rear lever 167.

The front edge 161 of handle block 145 includes an upwardly extending wall 163. A hole 165 is provided through this wall. In use, a guitar string would be fed through hole 165 until the anchor 171 abuts the rear face 173 of the upwardly extending wall 163. The guitar string is then passed through the hole 122 in the front portion 137 of the mounting body 131. The string 138 then passes below the overhead bridge 120 and continues along the guitar and is attached to a tuning peg 121 (shown in FIG. 121) at the far end of the guitar. At this point the string would be tensioned until the tune of the string was satisfactory to the artist. During this process the position of the handle block 145 may change slightly as spring 139 is deformed under the tension of the spring. The position of the handle block 145 once the string has been tuned would define the neutral position of the spring 139.

The string bender 114 is activated by the upward or downward movement of the forward lever 159 or rear lever 167. If the forward lever 159 is pushed down, the rear edge 151 of the handle block 145 is raised and the second leg 143 of the U-shaped spring 139 is also raised. This causes the forward dip of the upwardly directed wall 163 and the forward dip of guitar string anchor 171. In performing this movement the guitar string tension is decreased, causing the tone of the string to decrease as well. If the forward handle 159 is raised or the rear lever 167 is depressed, the rear edge 151 of handle block 145 is moved downward and the second leg 143 of the U-shaped spring 139 is also moved downwards towards the first leg 141. This causes the upwardly directed wall 163 of the handle block 145 to be raised moving the guitar string anchor 171 upwardly and rearwardly. This increases the tension on the guitar string 138 and thus raises the tone of the string.

Screws 142*a* and 142*b* are provided to engage with holes 131*a* and 131*b* in arms 130*a* and 130*b* respectively. The bottom ends of the screws 142*a* and 142*b* abut the top surface of the bridge plate 100. By adjusting the position of the screws 142*a* and 142*b*, the guitar string height can be adjusted.

Figure 11:
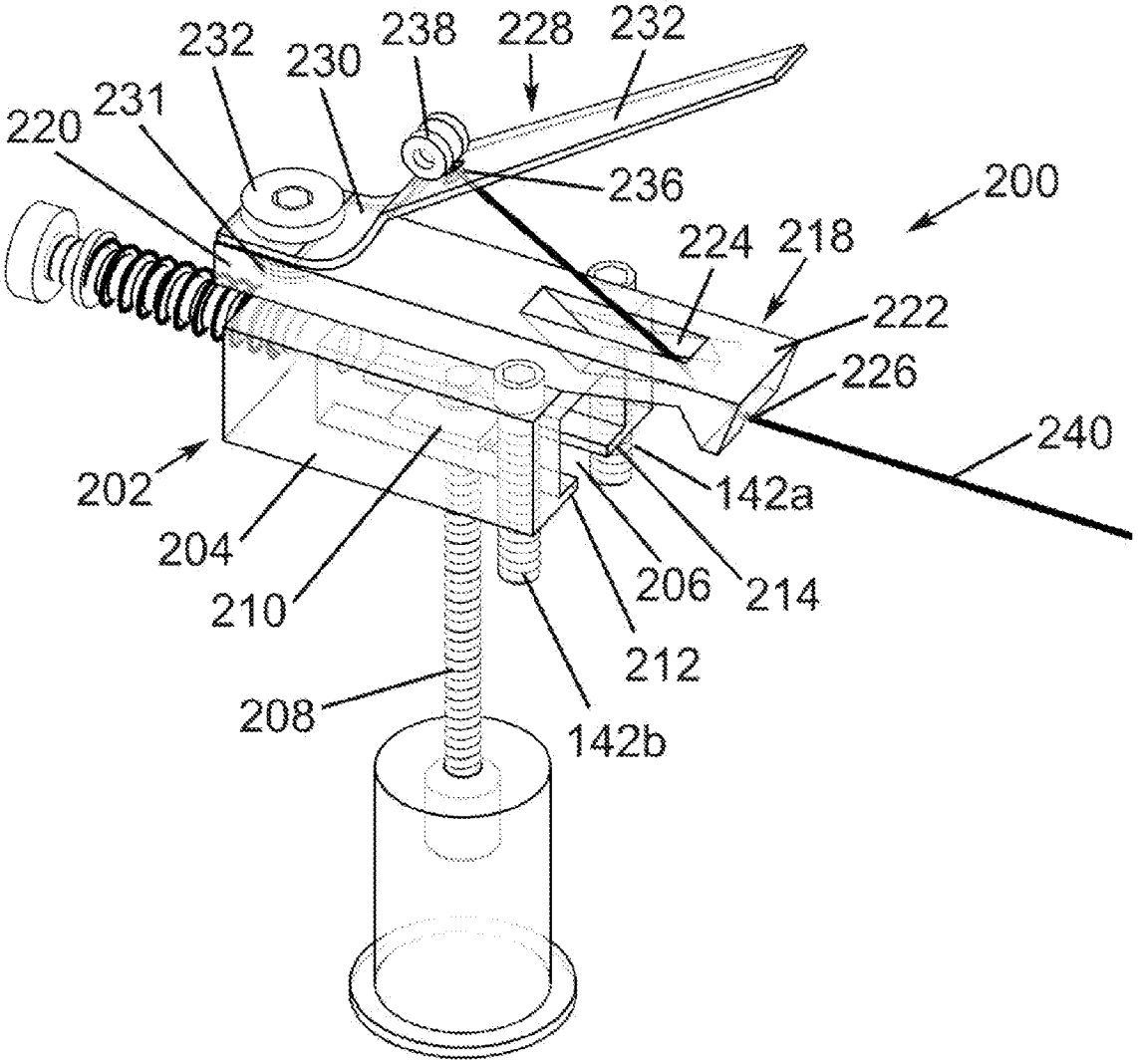
FIG. 11 shows a perspective view of a third embodiment of the guitar string bender.
Figure 12:
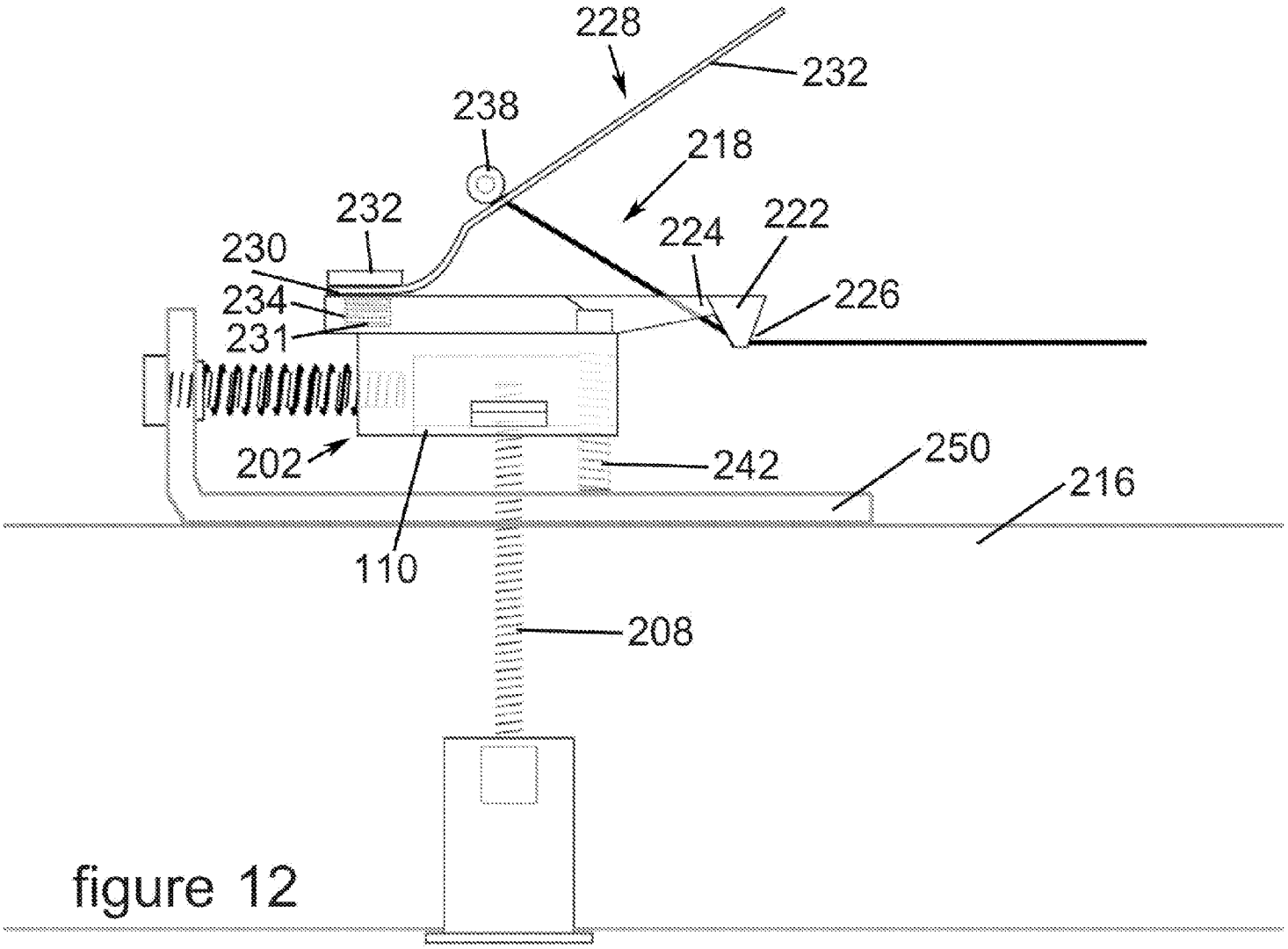
FIG. 12 shows a side elevation view of the third embodiment of the guitar string bender mounted on a guitar body having a bridge plate assembly.

An alternative embodiment of a string bender 200 for mounting on a guitar with a bridge plate apparatus is shown in FIGS. 11 and 12. The mounting block 202 has a base portion 204 which is equipped with a T-shaped channel 206 through the middle thereof. As shown in FIG. 11, a mounting screw 208 is fed up through the back of the guitar and is provided with a T-shaped bolt 210 for engagement with the T-shaped channel 206.

The mounting block 202 can receive the bolt 210 of the mounting screw 208 within its shaped channel 206. The walls 212 and 214 of the T-shaped channel 206 can accommodate the head of the mounting screw 208 while the upper portion of the T-shaped channel 206 can accommodate any excess screw length and allow for the adjustment of the height of the mounting block 202 from the guitar body 216.

Above the mounting block and attached integrally thereto is a handle mounting body 218. The rear portion 220 of the handle mounting portion 218 is equipped with a hole to receive a screw. The forward portion 222 of the handle body 218 is equipped with an aperture 224 and an overhead bridge 226. A handle member 228, having a base portion 230 and a lever 232 is coupled to the rear portion 220 of the handle mounting block 218 via screw 231 which passes through a hole in the base portion 230 of the handle 228 and engages threads in a hole 234 of the handle mounting block 218.

A guitar string is passed through another hole 236 in the lever 232 until the anchor 238 abuts the lever 232. The guitar string is then passed through the aperture 224 in the forward portion 222 of the handle block 218 and under the overhead bridge 226. The guitar string is then fixed at the far end of the guitar to a tuning peg 121. As with the previous design, the artist can then adjust the length of the guitar string using the tuning peg 121 to achieve a desired neutral tone.

The string bender 200 is activated by the upward or downward movement of the lever 232. The downward movement of the lever 232 moves the string anchor 238 towards the tuning peg 121, which decreases the tension of the string 240 and thus the tone of string 240 is lowered.

In contrast, the upward movement of the lever 232 causes the string anchor 238 of the string 240 to be moved away from the tuning pegs and thus the tension of string 240 is increased. This raises the pitch of string 240.

Allen screws 242*a* and 242*b* are provided through and engaged with threaded holes in the walls 212 and 214 of the T-shaped channel 206. One end of the screws abuts the bridge plate 240. By adjusting the position of the screws 242*a* and 242*b*, the guitar string height can be adjusted.

As can be appreciated, the string bender design uses a spring component to maintain a neutral string position and allows flexibility to move the spring in two directions. This way the string can be adjusted upward in pitch and downward in pitch. The amount of the pitch can be varied and can change based on the spring material, spring size and other considerations, however, in a preferred embodiment it is possible to raise or lower the tone of the string by 3 and 5 semitones respectively.

Figure 13:
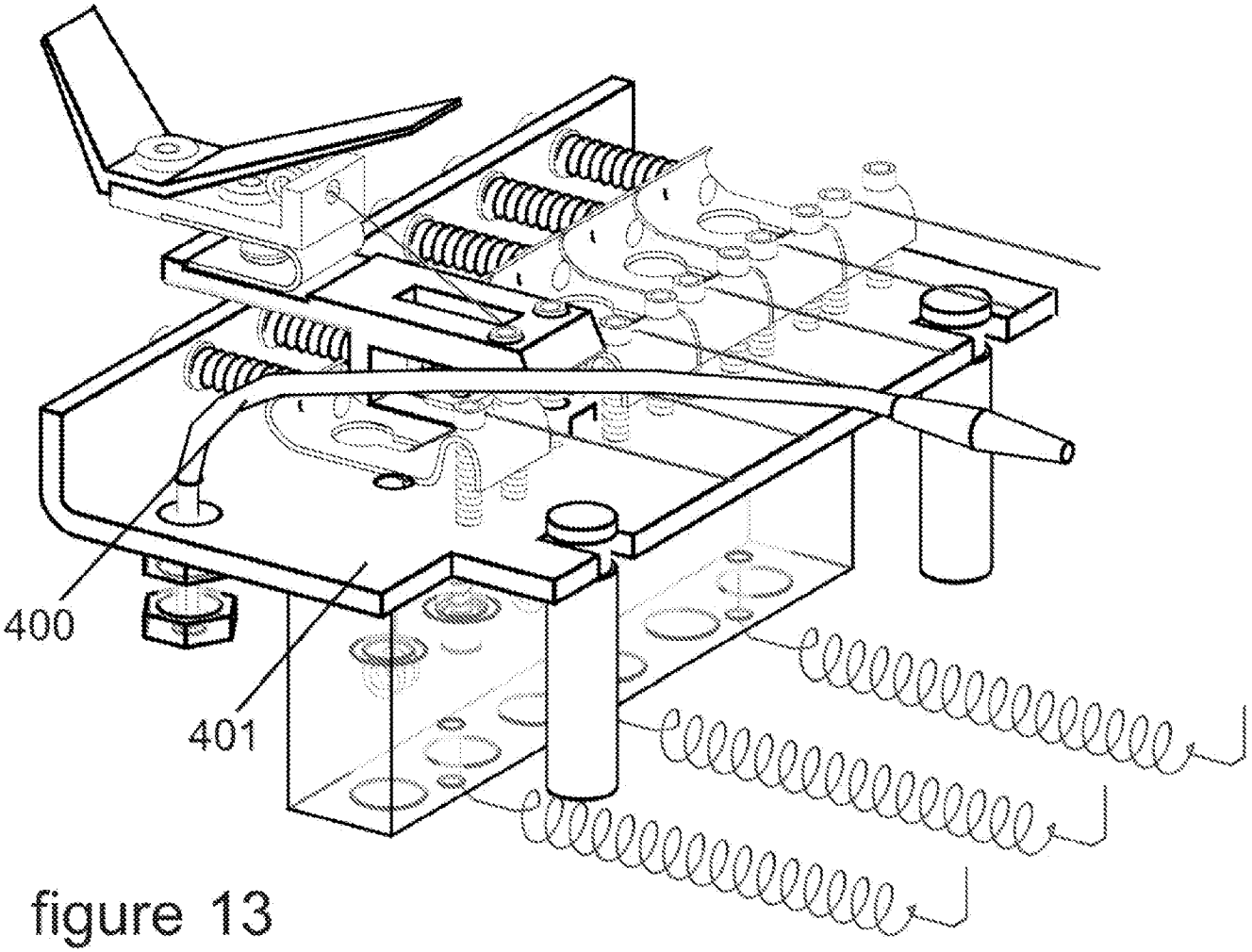
FIG. 13 shows a bridge plate assembly having the second embodiment of the guitar string bender mounted thereto wherein the plate assembly also includes a vibrato arm.

The string bender does not interfere with the mechanisms of a potential vibrato arm 400 already mounted on a bridge plate 401 as shown in FIG. 13.

Advantageously, the string bender uses existing structures of the guitar for its mounting means and requires no additional damage to the guitar. The string bender is simple in design and is small enough that each string could have a string bender attached thereto. This would maximize the creative opportunities for musicians.

Although various preferred embodiments of the present invention have been described herein in detail, it would be appreciated by those skilled in the art that that variations may be made thereto without departing from the appended claims.

I claim:

1. A string bender for use with a stringed instrument comprising a mount to couple the string bender to the stringed instrument;

a spring device coupled between said mount and an activation lever; and an anchoring arrangement to secure an anchor portion of an instrument string having a string portion and an anchor portion; said anchoring arrangement cooperating with said spring device such that when the instrument string is tensioned to achieve a desired neutral tone, the spring device is in a neutral position;

said spring device is deformable such that by moving the activation lever in a first direction, the spring device is deformed from the neutral position in a first direction and the anchor portion of the string is moved to create increased tension of said instrument string, which raises the tone produced by said instrument string.

2. A string bender as claimed in claim 1 wherein by moving the activation lever in a second direction, the spring device is deformed from the neutral position in a second direction and the anchor portion of the instrument string is moved to decrease the tension on the string, lowering the tone produced by the instrument string.

3. A string bender as claimed in claim 2 wherein said stringed instrument is a guitar and said instrument string is a guitar string.

4. A string bender as claimed in claim 3 wherein said anchoring arrangement is a string aperture sized to allow the string portion of said guitar string to pass through while preventing the passage of the anchor portion to secure the guitar string to said string bender.

5. A string bender as claimed in claim 1 wherein the mount is adapted to be coupled to a guitar having a tailpiece; and said mount comprises a mounting bolt sized such that the body of the mounting bolt passes through a string channel in the tailpiece of a guitar while the head of the mounting both abuts a surface about the channel.

6. A string bender as claimed in claim 5 wherein said spring device is U-shaped having a first leg and a second leg; and the body of said mounting bolt passes through the channel and engages said first leg of said U-shaped spring device.

7. A string bender as claimed in claim 6 wherein said second leg of said spring device is coupled to the activation lever and said string aperture is provided in the second leg of said spring device.

8. A string bender as claimed in claim 4 wherein the mount is adapted to be coupled to a guitar having a bridge plate assembly and a channel extending through the guitar body; and wherein a mounting bolt is used to couple said mount to said guitar body; said mounting bolt comprising a body and a head; said body of said mounting bolt is sized to pass through said channel and said head is sized to abut a surface about said channel; once passed through said channel, said mounting bolt body engages said mount, coupling the mount to the guitar.

9. A string bender as claimed in claim 8 wherein said spring device is U-shaped and has a first leg and a second leg; said first leg is coupled horizontally to said mount and said second leg is coupled to said activation lever.

10. A string bender as claimed in claim 9 wherein said mount includes an overhead bridge and anchoring arrangement is positioned above and rearwardly of said overhead bridge.

11. A string bender as claimed in claim 10 wherein a lever mount is coupled between said second leg of said spring device and said lever; said lever mount including said string aperture for securing said guitar string.

12. A string bender as claimed in claim 11 wherein said activation lever includes a forwardly extending handle and a rearwardly extending handle.

13. A string bender for use with a stringed instrument comprising a mount to couple the string bender to the stringed instrument;

a spring device coupled between said mount and an activation lever; and an anchoring arrangement to secure an anchor portion of an instrument string having a string portion and an anchor portion; said anchoring arrangement cooperating with said spring device such that when the instrument string is tensioned to achieve a desired neutral tone, the spring device is in a neutral position;

said spring device is deformable such that by moving the activation lever in a first direction, the spring device is deformed from the neutral position in a first direction and the anchor portion of the instrument string is moved to decrease the tension of the instrument string, lowering the tone produced by the instrument string.

* * * * *